US008919524B2

(12) United States Patent
Kim

(10) Patent No.: US 8,919,524 B2
(45) Date of Patent: Dec. 30, 2014

(54) OBJECT PROCESSING APPARATUS AND FINANCIAL APPARATUS

(75) Inventor: Hyun Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 68 days.

(21) Appl. No.: 13/607,035

(22) Filed: Sep. 7, 2012

(65) Prior Publication Data

US 2013/0061699 A1 Mar. 14, 2013

(30) Foreign Application Priority Data

Sep. 8, 2011 (KR) ..... 10-2011-0091183

(51) Int. Cl.

| | |
|---|---|
| ***G07F 11/00*** | (2006.01) |
| ***E05F 15/12*** | (2006.01) |
| ***G07D 11/00*** | (2006.01) |
| ***G07F 19/00*** | (2006.01) |

(52) U.S. Cl.

CPC ..... *G07D 11/0018* (2013.01); *G07F 19/202* (2013.01)

USPC ..... 194/351; 49/139

(58) Field of Classification Search

CPC ..... G07D 2211/00; E05F 15/00

USPC ..... 194/351, 203; 49/139, 140, 349; 235/1 A; 232/44

See application file for complete search history.

(56) References Cited

U.S. PATENT DOCUMENTS

| | | | | |
|---|---|---|---|---|
| 5,146,070 | A * | 9/1992 | Toma | 235/475 |
| 7,751,757 | B2 | 7/2010 | Kim et al. | |
| 7,925,375 | B2 | 4/2011 | Schininger et al. | |
| 2005/0284925 | A1 | 12/2005 | Ahn et al. | |
| 2013/0184856 | A1 * | 7/2013 | Gregerson | 700/232 |

FOREIGN PATENT DOCUMENTS

| | | | |
|---|---|---|---|
| CN | 1716322 | A | 1/2006 |
| CN | 10-1002234 | A | 7/2007 |
| CN | 10-1414143 | A | 4/2009 |
| KR | 10-2002-0055269 | A | 7/2002 |
| KR | 10-0603936 | B1 | 7/2006 |
| KR | 10-0610806 | B1 | 8/2006 |
| KR | 10-2006-0129614 | A | 12/2006 |
| KR | 10-2011-0091183 | A | 8/2011 |

OTHER PUBLICATIONS

Notice of Allowance dated Feb. 28, 2013 in Korean Application No. 10-2011-0091183, filed Sep. 8, 2011, (2 pages).

Office Action dated Apr. 21, 2014 in Chinese Application No. 201210330221.6.

* cited by examiner

*Primary Examiner* — Mark Beauchaine

(74) *Attorney, Agent, or Firm* — Saliwanchik, Lloyd & Eisenschenk

(57) ABSTRACT

Provided are an object processing apparatus and a financial apparatus. The object processing apparatus comprises a motor, a shutter configured to close and open an object-entrance space, and a power transmission. The power transmission is configured to open or close the shutter according to operation of the motor and allow the shutter to be opened or closed by an external force when the motor is not operated. The power transmission transmits a driving force of the motor to the shutter without any electronic control.

20 Claims, 8 Drawing Sheets

OBJECT PROCESSING APPARATUS AND FINANCIAL APPARATUS

CROSS-REFERENCE TO RELATED APPLICATION

This application claims the benefit under 35 U.S.C. §119 of Korean Patent Application No. 10-2011-0091183, filed Sep. 8, 2011, which is hereby incorporated by reference in its entirety.

BACKGROUND

The present disclosure relates to an object processing apparatus and a financial apparatus.

Generally, object processing apparatuses are used to process input or inner objects and discharge the processed objects. Examples of object processing apparatuses comprise a financial apparatus.

Financial apparatuses automatically process financial transactions according to customer's demands. Financial apparatuses may deposit/withdraw media (such as paper money, checks, securities, and gift certificates), or automatically transfer the media.

Such a financial apparatus comprises a medium entrance for depositing/withdrawing a medium, and a medium introduced through the medium entrance is stored in a medium storage. The medium storage comprises: a temporary storage in which a medium inserted by a user is temporarily stored; a cassette in which a medium is stored; and a collector in which an abnormal medium is stored.

In the related art, a driving motor may be disposed at a medium entrance to drive a shutter, and a power transmission may be disposed between the driving motor and the shutter. The power transmission may transmit a driving force from the driving motor to the shutter to operate the shutter. If the shutter is moved by a customer in a state where the driving motor is not operated, the power transmission connected to the driving motor may be rotated due to a large gear ratio, and gears or the driving motor may be damaged.

Furthermore, in the related art, a clutch may be disposed at a medium entrance to connect a driving motor and a shutter. The clutch may electronically be controlled to transmit or not to transmit power. However, electronically controllable clutches are expensive, and a complicated control method is necessary to electronically control a driving motor.

BRIEF SUMMARY

Embodiments provide an object processing apparatus and a financial apparatus.

In one embodiment, an object processing apparatus comprises: a motor; a shutter configured to close and open an object-entrance space; and a power transmission configured to open or close the shutter according to operation of the motor and allow the shutter to be opened or closed by an external force when the motor is not operated, wherein the power transmission transmits a driving force of the motor to the shutter without any electronic control.

In another embodiment, an object processing apparatus comprises: a driving motor; a gear configured to receive a driving force from the motor; a shutter configured to close and open an object-entrance space; and a clutch shaft connected to the gear in a relatively rotatable manner and directly or indirectly connected to the shutter, wherein the clutch shaft comprises a protrusion, and the gear comprises an accommodation part providing a space in which the protrusion is movable so that the clutch shaft is rotatable relative to the gear.

In another embodiment, a financial apparatus comprises: a medium-entrance space; a shutter configured to close and open the medium-entrance space; a motor configured to drive the shutter; and a power transmission configured to open or close the shutter according to operation of the motor and allow the shutter to be opened or closed by an external force when the motor is not operated, wherein the power transmission transmits a driving force of the motor to the shutter without any electronic control.

DETAILED DESCRIPTION

Figure 1:
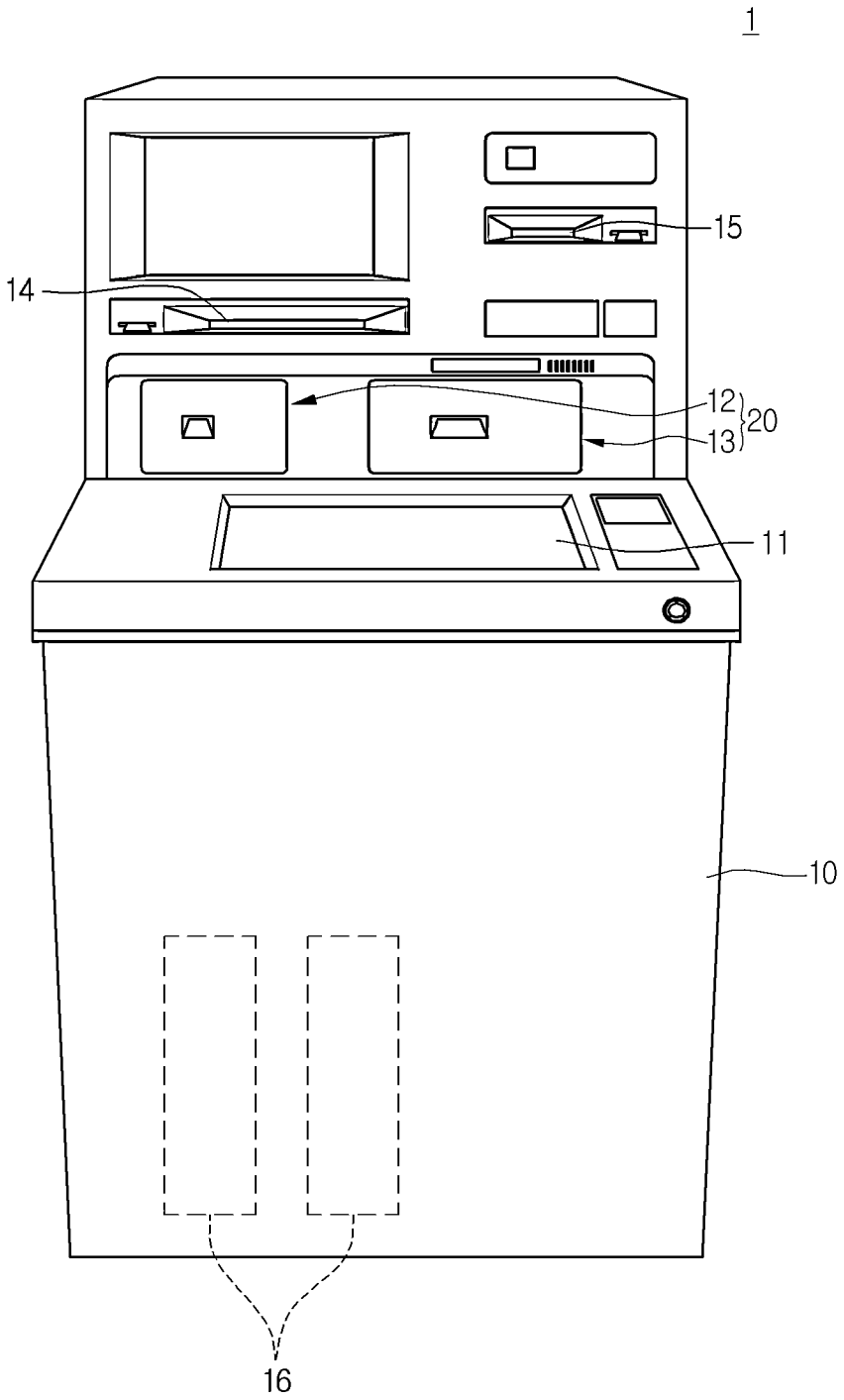
FIG. 1 is a perspective view illustrating a financial apparatus according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial apparatus according to embodiments is an apparatus that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial apparatus may comprise an automatic teller machine (ATM) such as a cash dispenser (CD) or a cash recycling device. However, the financial apparatus is not limited to the above-described examples. For example, the financial apparatus may be an apparatus for automatically performing the financial businesses such as a financial information system (FIS).

Hereinafter, assuming that the financial apparatus is the ATM, an embodiment will be described. However, this assumption is merely for convenience of description, and technical idea of the present disclosure is not limited to the ATM.

Figure 2:
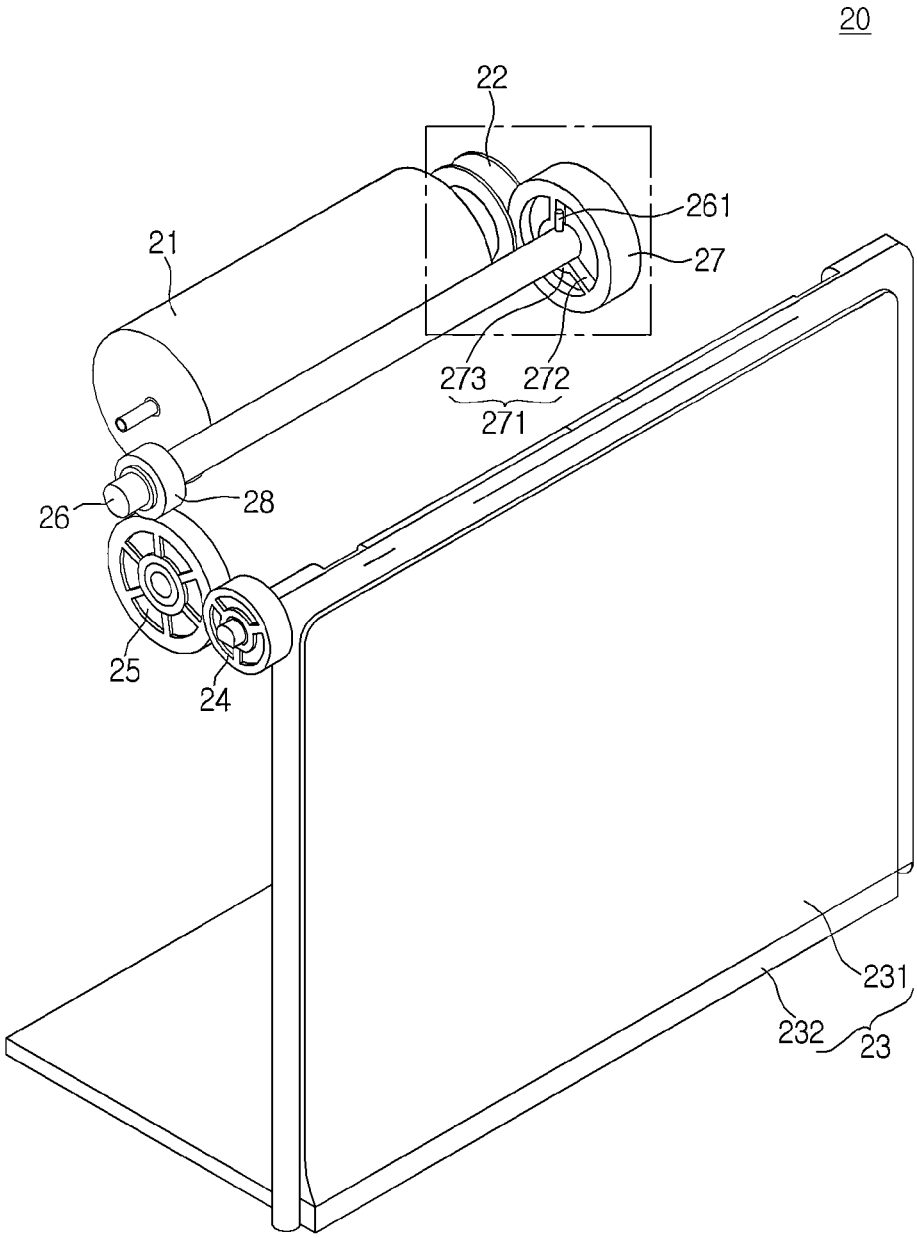
FIG. 2 is a schematic view illustrating an object processing apparatus according to an embodiment.
Figure 3:
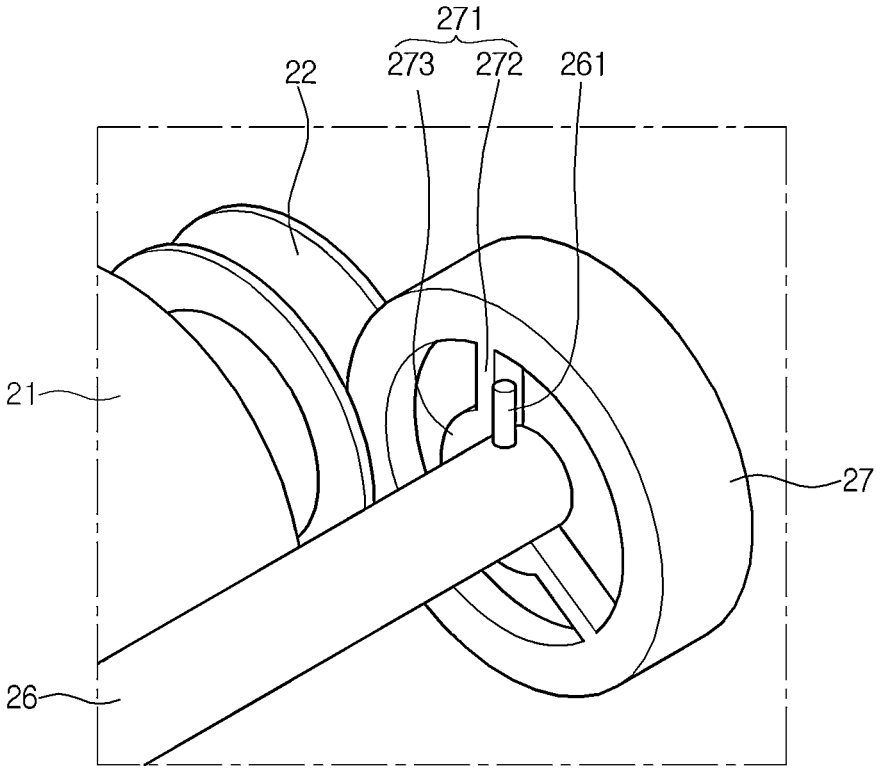
FIG. 3 is an enlarged view illustrating the object processing apparatus of FIG. 2.

Furthermore, in the following description, an explanation will be given for an exemplary case where an object processing apparatus is used as a medium processing apparatus for processing media in a financial apparatus, FIG. 1 is a perspective view illustrating a financial apparatus 1 according to an embodiment, FIG. 2 is a schematic view illustrating an object processing apparatus 20 according to an embodiment, and FIG. 3 is an enlarged view illustrating the object processing apparatus 20 of FIG. 2. In FIGS. 2 and 3, gear teeth are not shown for simplicity.

Referring to FIG. 1, the financial apparatus 1 comprises a main body 10 in which a plurality of parts are disposed. The main body 10 may comprise an input part 11 for a user to perform a financial process, a check entrance device 12 through which a check is input and output, a paper money entrance device 13 through which a paper money is input and output, a bankbook entrance device 14 through which a bankbook is input and output, a card entrance device 15 through which an integrated circuit (IC) card is input and output for performing a financial process, and medium storages 16 for storing media.

The medium storages 16 comprise any module disposed in the financial apparatus 1 to put media therein. Examples of the medium storages 16 comprise: a temporary storage (not shown) used to temporarily store a medium which a user has inserted; a recycle box (not shown) used to store a medium; a collector (not shown) used to collect an abnormal medium; and a cassette (not shown) used to store a medium.

In some embodiments, one or more of the check entrance device 12, the paper money entrance device 13, the bankbook entrance device 14, and the card entrance device 15 may be not comprised in the financial apparatus 1. The check entrance device 12 and the paper money entrance device 13 are referred to collectively in the following description as an object processing apparatus 20.

Referring to FIGS. 2 and 3, the object processing apparatus 20 may comprise a motor 21, a shutter 23, and a power transmission configured to selectively transmit power from the motor 21 to the shutter 23.

The power transmission may comprise a first gear 22, a second gear 27, a first shutter gear 24, a second shutter gear 25, a third shutter gear 28, and a clutch shaft 26.

According to the technical idea of the present disclosure, the structure of the power transmission is not limited thereto. For example, the power transmission may comprise one or more gears, the shutter 23 may be connected to the clutch shaft 26, or the clutch shaft 26 may be provided on the shutter 23. In an embodiment, the power transmission may comprise: a gear receiving power from the motor 21; and a clutch shaft that can receive power from the gear and is connected to the shutter 23 directly or indirectly. The clutch shaft may be connected to the gear in a manner such that the clutch shaft can be rotated relative to the gear.

The motor 21 generates a torque to be applied to the shutter 23. The motor 21 may be a bidirectional motor.

The first gear 22 may be coupled to a shaft of the motor 21. As the shaft of the motor 21 rotates, the first gear 22 is rotated. The first gear 22 may be engaged with the second gear 27 to rotate the clutch shaft 26.

The shutter 23 is used to close and open a medium-entrance space through which a medium is inserted and discharged. The shutter 23 may comprise an external shutter 231 and an internal shutter 232, and the internal shutter 232 may be a rotary or linear-motion shutter. The internal shutter 232 may be used to directly close the medium-entrance space, and the external shutter 231 may be disposed outside the main body 10 to close a space formed on an upper end of the internal shutter 232.

In this case, the external shutter 231 may be rotated by the motor 21 or a user to indirectly close or open the medium-entrance space. That is, the medium-entrance space may be opened by opening the external shutter 231 and then the internal shutter 232. In the current embodiment, the structure of the shutter 23 is not limited to the above-described structure.

The first shutter gear 24 is connected to a side of the external shutter 231 to rotate the external shutter 231. The first shutter gear 24 may directly or indirectly connected to the clutch shaft 26 to receive a torque from the motor 21 and rotate the shutter 23.

The second shutter gear 25 engages with the first shutter gear 24. If the motor 21 rotates, the second gear 27 engaged with the first gear 22 is rotated, and thus the clutch shaft 26 is rotated. At this time, the third shutter gear 28 may be engaged with the second shutter gear 25 so that the second shutter gear 25 can transmit a torque received from the motor 21 to the first shutter gear 24 for rotating the external shutter 231.

If the external shutter 231 is rotated by a user (that is, the external shutter 231 is rotated by an external force), the first shutter gear 24 is rotated by the external force, and thus the second shutter gear 25 engaged with the first shutter gear 24 is also rotated. At this time, the third shutter gear 28 engaged with the second shutter gear 25 rotates the clutch shaft 26. However, in the current embodiment, although the external shutter 231 is rotated by an external force applied by a user, since the clutch shaft 26 idles, the second gear 27 is not rotated.

Therefore, in the current embodiment, the second gear 27 is not forcibly rotated by an external force applied by a user, and thus the second gear 27, the first gear 22, and the motor 21 can be inhibited from being damaged.

The clutch shaft 26 is indirectly connected to the first shutter gear 24, and at least one pin 261 protrudes from the outer surface of the clutch shaft 26. That is, the clutch shaft 26 may be connected to the first shutter gear 24 through the third shutter gear 28 (described later) and the second shutter gear 25. The pin 261 may also be referred as a protrusion. The pin 261 protrudes from the clutch shaft 26 in a direction perpendicular to the length direction of the clutch shaft 26.

The second gear 27 and the third shutter gear 28 are coupled to the clutch shaft 26, and if the motor 21 rotates, a torque is transmitted from the second gear 27 to the third shutter gear 28 through the clutch shaft 26.

On the other hand, if the external shutter 231 is rotated by a user in a state where the motor 21 does not operate, a torque is transmitted to the third shutter gear 28 and the clutch shaft 26 but not transmitted to the second gear 27. This is because the pin 261 rotates freely between ribs 271 of the second gear 27.

The second gear 27 is rotatably coupled to the clutch shaft 26 and is connected to the motor 21. The ribs 271 are disposed on a surface of the second gear 27, and the pin 261 is disposed in a space between the ribs 271. The ribs 271 may also be referred to as contact parts. The ribs 271 are spaced apart from each other, and each of the ribs 271 has a contact surface for making contact with the pin 261.

In another embodiment, the contact parts may comprise: a pin accommodation part (in which the pin 261 can be moved) disposed in a side of the second gear 27; and a contact part configured to press the pin 261. In other words, the contact parts may be a plurality of ribs 271, or a groove and a sidewall of the groove that are disposed in a side of the second gear 27. In the following description, an explanation will be given for the case where the contact parts are the ribs 271.

In another embodiment, only one rib 271 may be disposed on a side of the second gear 27. In this case, the rib 271 has: a first contact surface on a side thereof for making contact with a side of the pin 261; and a second contact surface on the other side thereof for making contact with the other side of the pin 261. That is, in the current embodiment, the second gear 27 comprises at least one rib. In other words, the second gear 27 comprises a plurality of contact surfaces.

The second gear 27 may be engaged with the first gear 22 and rotated by the first gear 22 when the motor 21 is operated. At this time, the rib 271 of the second gear 27 pushes the pin 261 of the clutch shaft 26, and thus the clutch shaft 26 is also rotated.

However, if the external shutter 231 is rotated by a user in a state where the motor 21 is not operated, the clutch shaft 26 does not rotate the second gear 27 but idles. At this time, the pin 261 disposed on the outer surface of the clutch shaft 26 moves between the ribs 271 of the second gear 27.

That is, when the external shutter 231 is pushed by a user, the clutch shaft 26 is rotated and the pin 261 is moved between the ribs 271. On the other hand, when the external shutter 231 is rotated by the motor 21, the pin 261 is pushed by the rib 271 so that the clutch shaft 26 can be rotated.

For this, the inner diameter of the second gear 27 may be greater than the outer diameter of the clutch shaft 26. In addition, a friction reducing member (not shown) may be disposed on the inner side of the second gear 27 that makes contact with the clutch shaft 26. Any material having a low roughness value may be used as the friction reducing member.

The ribs 271 may comprise: a guide rib 273 surrounding at least a portion of the outer surface of the clutch shaft 26; and one or more radial ribs 272 extending from the guide rib 273 in radial directions from the center line of the clutch shaft 26.

The guide rib 273 may have a circular shape with a cut-off portion at a position corresponding to the pin 261. Then, when the clutch shaft 26 idles, the pin 261 may move in a space between the radial ribs 272 without being hindered by the guide rib 273.

The pin 261 is disposed between the radial ribs 272, and when the motor 21 operates, the pin 261 is pushed by the radial rib 272 to rotate the clutch shaft 26. On the other hand, when the external shutter 231 is rotated by an external force, the pin 261 moves in a space between the radial ribs 272 without pushing the radial ribs 272 so that the clutch shaft 26 can idle while rotating a predetermined angle.

The third shutter gear 28 is coupled to the clutch shaft 26 and engaged with the second shutter gear 25. The second gear 27 and the third shutter gear 28 coupled to the clutch shaft 26 may be spaced apart from each other, and the second gear 27 and the third shutter gear 28 may have different outer diameters. If the outer diameters of the second gear 27 and the third shutter gear 28 are different, a rotation ratio can be changed. The outer diameters of the second gear 27 and the third shutter gear 28 may be varied according to design specifications of the external shutter 231 and the motor 21.

The second gear 27 may be provided as a separate part and coupled to the clutch shaft 26 while allowing idling of the clutch shaft 26. The third shutter gear 28 may be formed in one piece with the clutch shaft 26 or fixed to the clutch shaft 26 for being rotated together with the clutch shaft 26.

Hereinafter, operations will be described according to exemplary embodiments with reference to FIGS. 4 to 8.

Figure 4:
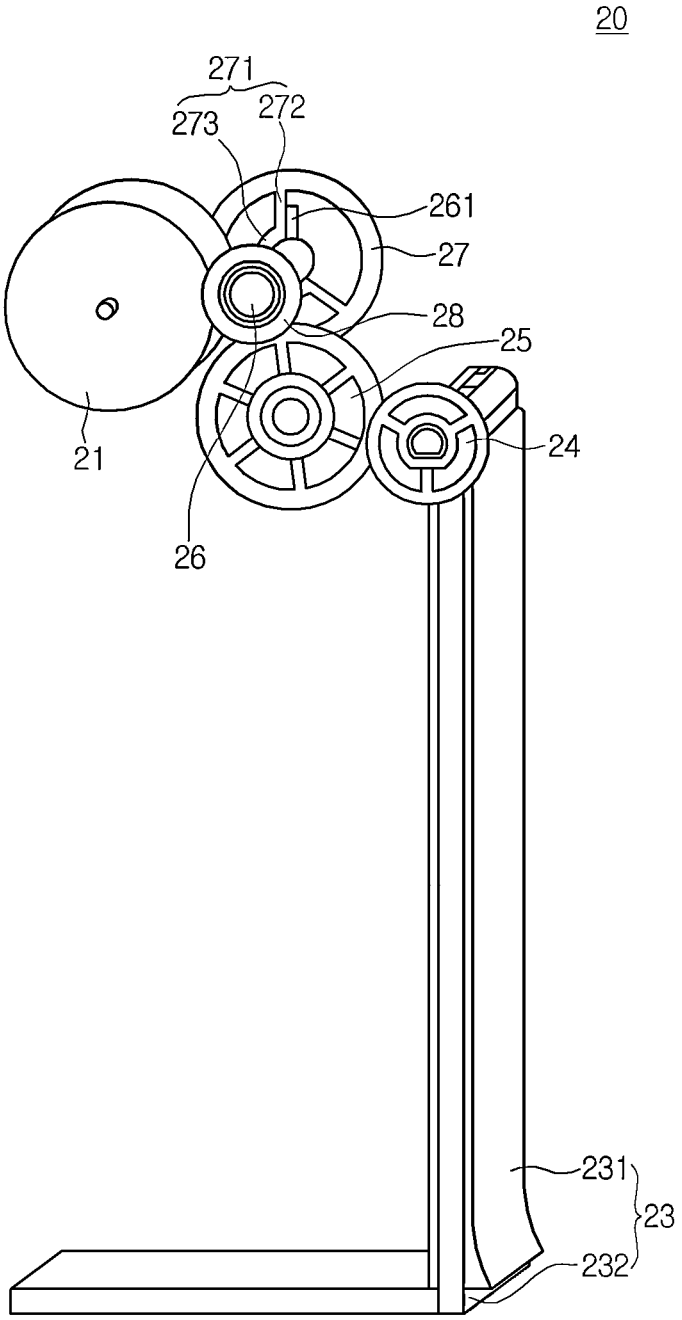
FIGS. 4 to 6 are views illustrating the object processing apparatus when an external shutter is opened and closed by a motor.
Figure 5:
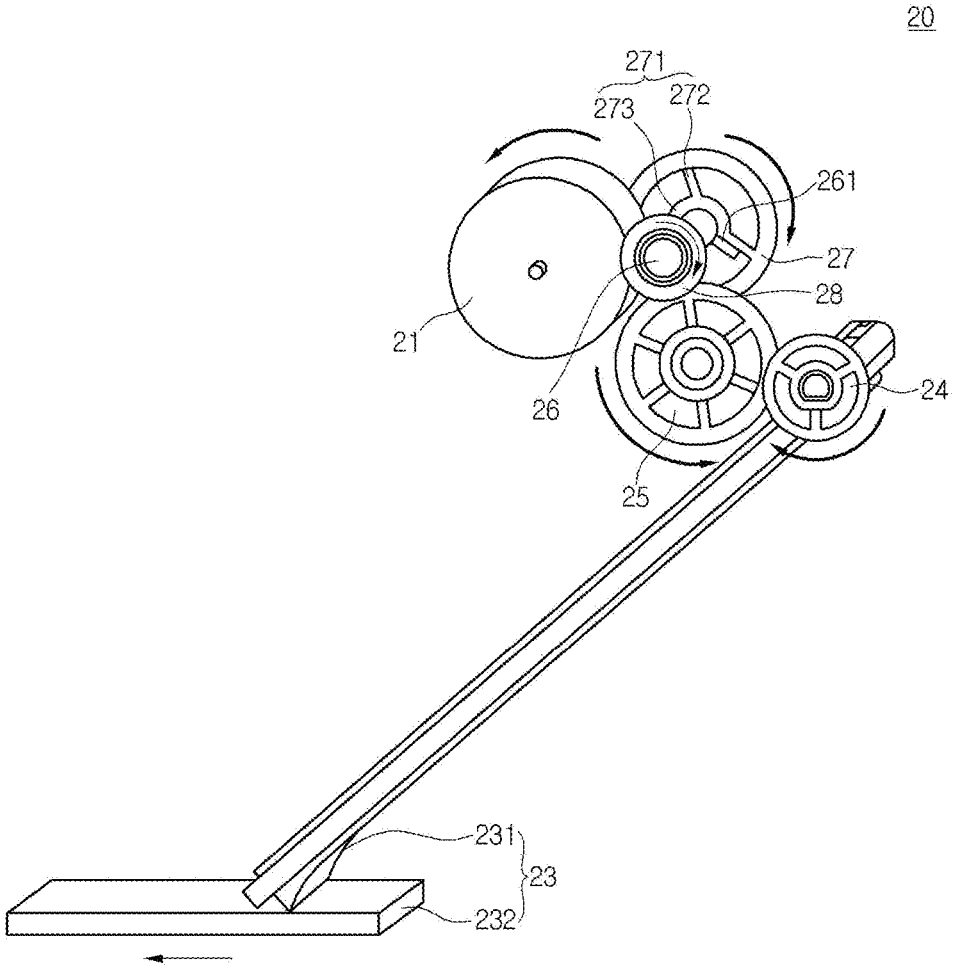
Figure 6:
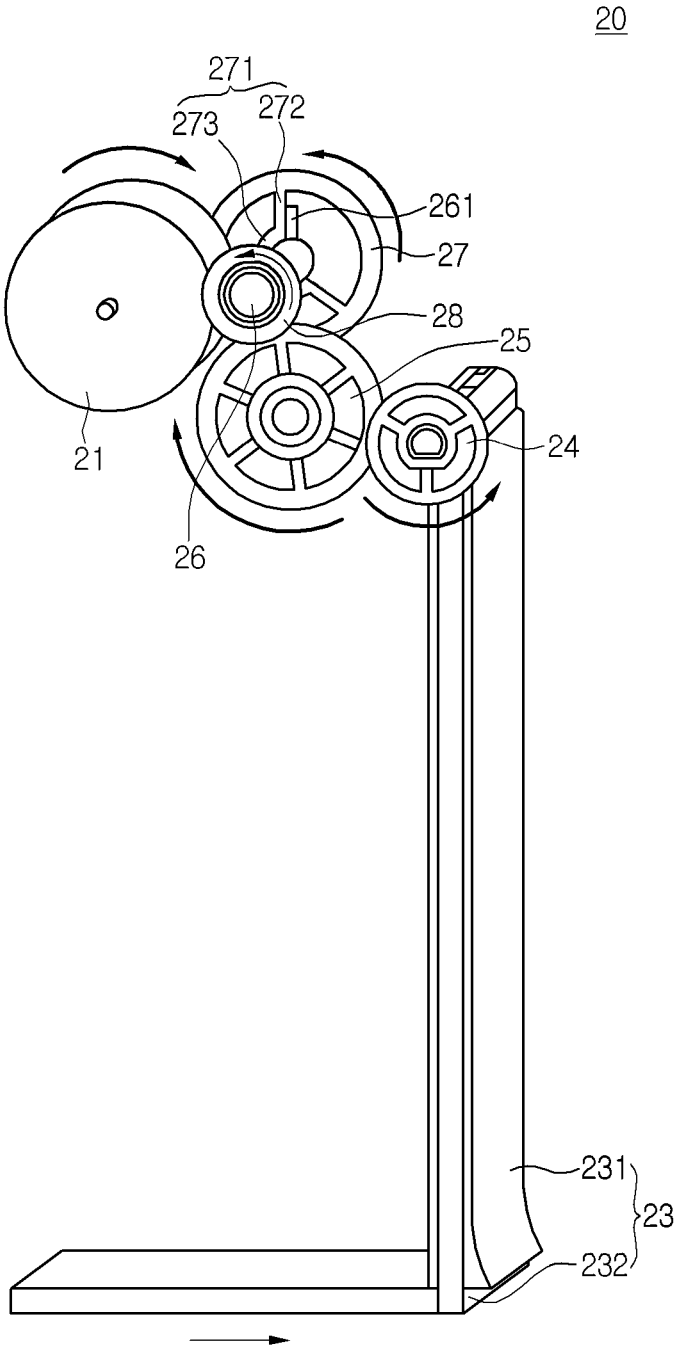
Figure 7:
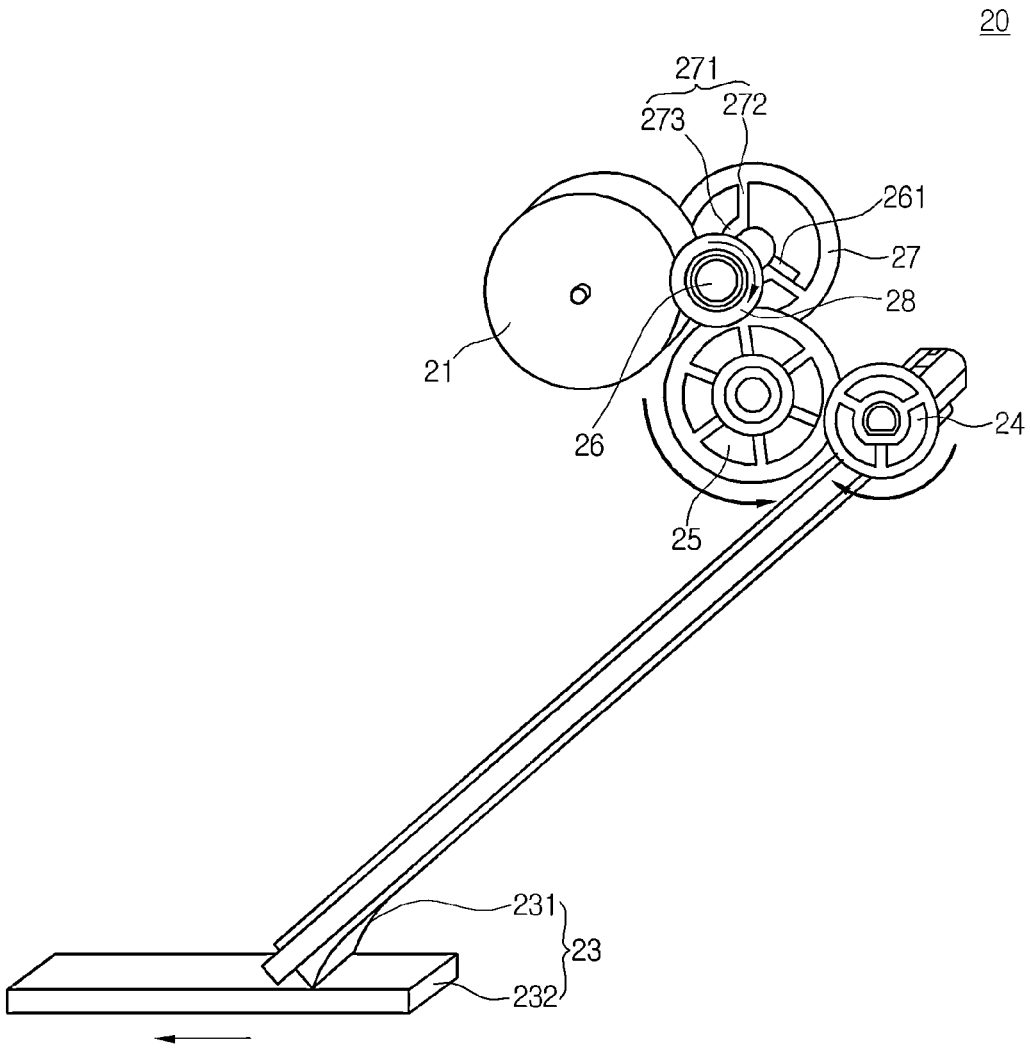
FIGS. 7 to 8 are views illustrating the object processing apparatus when the external shutter is opened and closed by an external force applied by a user.
Figure 8:
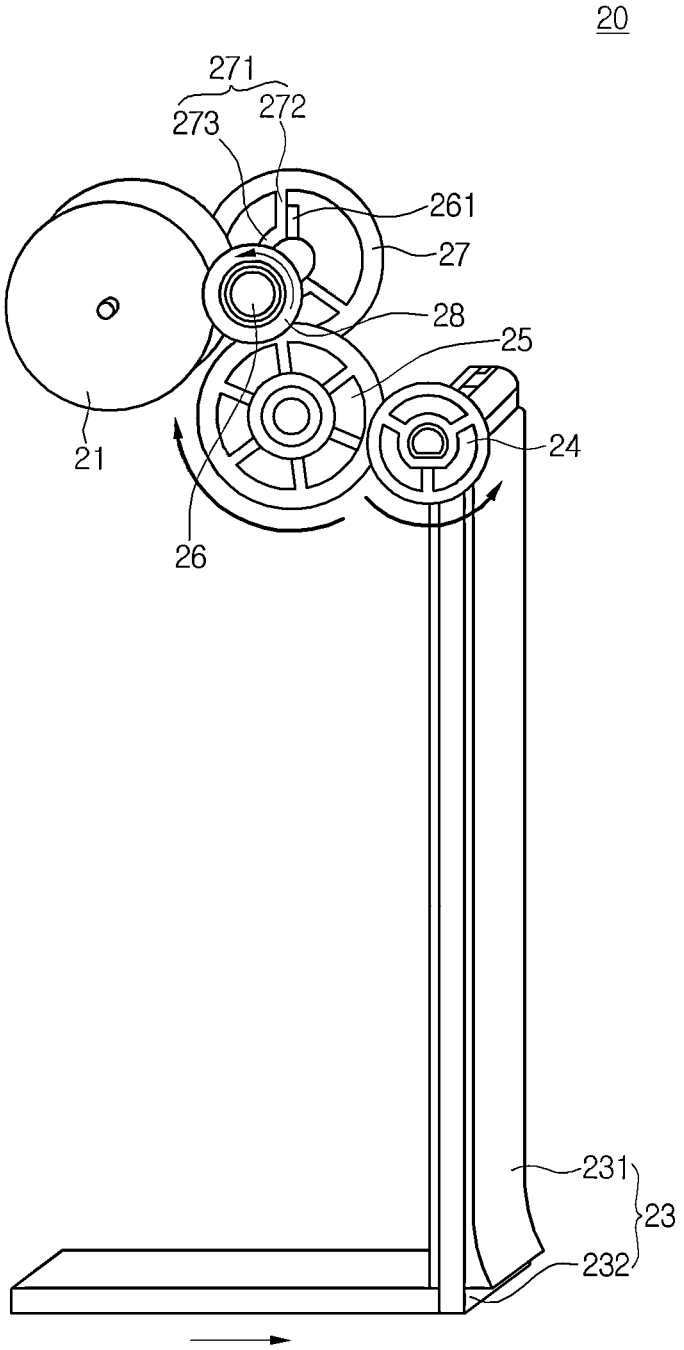

FIGS. 4 to 6 illustrate the object processing apparatus 20 when the external shutter 231 is opened or closed by the motor 21, and FIGS. 7 and 8 illustrate the object processing apparatus 20 when the external shutter 231 is opened or closed by an external force applied by a user. In FIGS. 4 and 8, gear teeth are not shown for simplicity.

Specifically, FIG. 4 shows a closed state of the external shutter 231, FIG. 5 shows a state where the external shutter 231 is opened by operation of the motor 21, and FIG. 6 shows a state where the external shutter 231 is closed by operation of the motor 21.

FIG. 7 shows a state where the external shutter 231 is opened by a pressing force applied from a user, and FIG. 8 shows a state where the external shutter 231 is closed and the motor 21 does not operate.

Referring to FIG. 4, the external shutter 231 may close an external part of the main body 10, and the internal shutter 232 may close an internal part of the main body 10. A medium may be inserted through a lower end of the internal shutter 232. As described above, the structure of the shutter 23 is not limited to this structure.

Referring to FIG. 5, if the motor 21 is rotated counterclockwise, the first gear 22 coupled to the shaft of the motor 21 is rotated to rotate the second gear 27. At this time, the radial rib 272 of the second gear 27 pushes the pin 261 of the clutch shaft 26, and thus the clutch shaft 26 may also be rotated.

If the clutch shaft 26 is rotated, the third shutter gear 28 is rotated together with the clutch shaft 26, and thus the second shutter gear 25 coupled to the third shutter gear 28 is also rotated. Then, the first shutter gear 24 engaged with the second shutter gear 25 is rotated, and thus the external shutter 231 is opened.

At this time, the internal shutter 232 may be linearly moved by an additional actuator (not shown) to open the medium-entrance space. In another embodiment, the internal shutter 232 may be connected to the motor 21 or the clutch shaft 26 so that the internal shutter 232 can be moved according to movement of the external shutter 231.

For this, a first belt pulley (not shown) may be provided to move the internal shutter 232, and a second belt pulley (not shown) may be provided to connect the first belt pulley and the clutch shaft 26. Then, the internal shutter 232 may be closed and opened according to movement of the external shutter 231.

Referring to FIG. 6, if the motor 21 is rotated clockwise, the first gear 22 is rotated, and thus the second gear 27 is rotated. At this time, since the radial ribs 272 are rotated in a direction where the pin 261 of the clutch shaft 26 is not pushed, the torque of the motor 21 is not transmitted to the clutch shaft 26, and thus the clutch shaft 26 is not rotated.

At this time, the clutch shaft 26 may be rotated counterclockwise by an elastic force of an elastic member (not shown). The elastic member may apply an elastic member to the clutch shaft 26 or the external shutter 231 to close the external shutter 231. The elastic member may be a spring. The elastic member may be disposed in the clutch shaft 26 or connected between the external shutter 231 and an external case (not shown).

Thus, although a torque of the motor 21 is not applied to the clutch shaft 26, the clutch shaft 26 may be rotated counterclockwise by a predetermined angle to the position shown in FIG. 6.

At this time, the internal shutter 232 may be moved by the additional actuator other than the motor 21 or the first and second belt pulleys so as to close the medium-entrance space.

Referring to FIG. 7, a user may push the external shutter 231 unlike the cases shown in FIGS. 5 and 6. In this case, the first shutter gear 24 connected to the external shutter 231 is rotated clockwise, and the second shutter gear 25 is rotated counterclockwise.

The third shutter gear 28 engaged with the second shutter gear 25 is rotated clockwise, and thus the clutch shaft 26 is rotated clockwise. At this time, the pin 261 of the clutch shaft 26 is moved between the radial ribs 272 and the radial ribs 272 are not pushed by the pin 261. That is, the clutch shaft 26 idles, and the second gear 27 is not rotated, Therefore, although a user rotates the external shutter 231, since the second gear 27 engaged with the first gear 22 is not rotated, parts of the object processing apparatus 20 can be inhibited from being damaged by forcible rotation.

At this time, the internal shutter 232 may be moved regardless of movement of the external shutter 231, or the internal shutter 232 may be connected to the clutch shaft 26 through the first and second belt pulleys and be rotated by a torque from the internal shutter 232.

Referring to FIG. 8, if an external force applied to the external shutter 231 is removed, the clutch shaft 26 is rotated counterclockwise by the elastic member, and this torque is transmitted to the external shutter 231 through third shutter gear 28, the second shutter gear 25, and the first shutter gear 24. Thus, the external shutter 231 is closed. At this time, the pin 261 of the clutch shaft 26 is moved between the radial ribs 272 and the radial ribs 272 are not pushed by the pin 261. Thus, the second gear 27 is not rotated.

That is, if the motor 21 is not operated, although the external shutter 231 is opened or closed, the second gear 27 is not rotated. In this way, unnecessary forcible rotation of the second gear 27 and the first gear 22 can be inhibited. That is, according to the current embodiment, the object processing apparatus 20 can have a simple and durable structure.

At this time, the internal shutter 232 may be moved to close the medium-entrance space by the additional actuator other than the motor 21 or the first and second belt pulleys connected to the clutch shaft 26.

In the embodiment, the power transmission closes or opens the shutter 23 according to operation of the motor 21 without requiring electronic control, and if the shutter 23 is rotated by an external force in a state where the motor 21 is not operated, the power transmission functions as a mechanical clutch to inhibit the torque of the shutter 23 to be transmitted to the motor 21.

The embodiments have been explained for the case where the object processing apparatus is used in the financial apparatus. However, the object processing apparatus can be used for any product having an object processing function. For example, the object processing apparatus may be used in a vending machine.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, the claimed invention is defined not by the detailed description of the invention but by the appended claims, and all differences within the scope will be construed as being comprised in the present disclosure.

What is claimed is:

1. An object processing apparatus comprising:

a motor;

a shutter configured to close and open an object-entrance space; and a mechanical power transmission configured to open or close the shutter according to operation of the motor and allow the shutter to be opened by an external force when the motor is not operated, wherein the shutter is opened or closed when the motor is operated.

2. The object processing apparatus of claim 1, wherein the mechanical power transmission comprises:

a gear configured to receive a driving force from the motor; and a clutch shaft directly or indirectly connected to the shutter, the clutch shaft being connected to the gear in a relatively rotatable manner.

3. The object processing apparatus of claim 2, wherein the clutch shaft comprises a protrusion, and the gear comprises a plurality of contact surfaces contacting the protrusion.

4. The object processing apparatus of claim 3, wherein the protrusion extends in a direction perpendicular to a length direction of the clutch shaft.

5. The object processing apparatus of claim 3, wherein if the gear is rotated in a direction, one of the contact surfaces pushes the protrusion to rotate the clutch shaft.

6. The object processing apparatus of claim 3, wherein the contact surfaces comprises:

a first contact surface on a side of a first rib of the gear; and a second contact surface on a side of a second rib of the gear spaced apart from the first rib.

7. The object processing apparatus of claim 3, wherein the contact surfaces comprises:

a first contact surface on a side of a rib of the gear; and a second contact surface of the other side of the rib.

8. The object processing apparatus of claim 3, wherein the gear comprises a guide rib surrounding at least a portion of an outer surface of the clutch shaft.

9. The object processing apparatus of claim 2, wherein if the shutter is rotated by an external force in a state where the motor is not operated, the clutch shaft idles in a manner such that the clutch shaft is rotated by a predetermined angle with reference to the gear.

10. The object processing apparatus of claim 2, further comprising an elastic member configured to apply an elastic force to the clutch shaft or the shutter.

11. The object processing apparatus of claim 10, wherein if the motor is operated, a driving force of the motor is transmitted to the shutter through the mechanical power transmission to open the shutter, and if the motor is not operated, an elastic force of the elastic member is applied to the shutter to close the shutter.

12. An object processing apparatus comprising:

a driving motor;

a gear configured to receive a driving force from the motor;

a shutter configured to close and open an object-entrance space; and a clutch shaft connected to the gear in a relatively rotatable manner and directly or indirectly connected to the shutter, wherein the clutch shaft comprises a protrusion, and the gear comprises an accommodation part providing a space in which the protrusion is movable so that the clutch shaft is rotatable relative to the gear.

13. The object processing apparatus of claim 12, wherein the accommodating part comprises a plurality of contact surfaces.

14. The object processing apparatus of claim 13, wherein if the motor is operated to open the shutter, one of the contact surfaces makes contact with the protrusion so that the clutch shaft receives a driving force from the motor.

15. The object processing apparatus of claim 13, wherein if the shutter is rotated by an external force in a state where the motor is not operated, the protrusion is moved in the accommodation part and the gear is not rotated.

16. The object processing apparatus of claim 13, further comprising an elastic member configured to apply an elastic force to the shaft or the shutter, wherein if the motor is not operated in a state where the shutter is opened, an elastic force of the elastic member is applied to the shutter to close the shutter.

17. A financial apparatus comprising:

a medium-entrance space;

a shutter configured to close and open the medium-entrance space;

a motor configured to drive the shutter; and a mechanical power transmission configured to open or close the shutter according to operation of the motor and allow the shutter to be opened by an external force when the motor is not operated, wherein the shutter is opened or closed when the motor is operated.

18. The financial apparatus of claim 17, wherein the mechanical power transmission comprises:

a gear configured to receive a driving force from the motor; and a clutch shaft directly or indirectly connected to the shutter, the clutch shaft being connected to the gear in a relatively rotatable manner.

19. The financial apparatus of claim 18, wherein the clutch shaft comprises a protrusion, and the gear comprises an accommodation part providing a space in which the protrusion is movable so that the clutch shaft is rotatable relative to the gear.

20. The financial apparatus of claim 19, wherein the accommodating part comprises a plurality of contact surfaces, and if the motor is operated to open the shutter, one of the contact surfaces makes contact with the protrusion so that the clutch shaft receives a driving force from the motor.

* * * * *